US005208584A

United States Patent [19]

Kaye et al.

[11] Patent Number: 5,208,584

[45] Date of Patent: May 4, 1993

[54] TRAFFIC LIGHT AND BACK-UP TRAFFIC CONTROLLER

[76] Inventors: Jonathan Kaye, 11 Pond Path, Woodbury, N.Y. 11797; Albert Briffa, 2 Stardom Ct., St. James, N.Y. 11780

[21] Appl. No.: 753,921

[22] Filed: Sep. 3, 1991

[51] Int. Cl.[5] ..... G08G 1/095

[52] U.S. Cl. ..... 340/907; 340/478; 340/916; 340/931

[58] Field of Search ..... 340/907, 478, 908, 916, 340/924, 931, 918, 932

[56] References Cited

U.S. PATENT DOCUMENTS

| | | | |
|---|---|---|---|
| 2,401,940 | 6/1946 | Lange . | |
| 3,087,069 | 4/1963 | Moncrieff-Yeates . | |
| 3,194,967 | 7/1965 | Mash . | |
| 3,222,531 | 12/1965 | Morrison . | |
| 3,251,031 | 5/1966 | Bolton | 340/916 |
| 3,336,574 | 9/1967 | Selzer . | |
| 3,482,208 | 12/1969 | Aver et al. . | |
| 3,579,207 | 5/1971 | Bartlett et al. | 340/916 |
| 3,596,239 | 7/1971 | Hata . | |
| 3,629,600 | 12/1971 | Studer . | |
| 3,641,487 | 2/1972 | Rogers et al. . | |
| 3,675,196 | 7/1972 | Molloy et al. . | |
| 3,893,067 | 7/1975 | Watanabe et al. . | |
| 4,008,404 | 2/1977 | Foreman | 307/149 |
| 4,276,534 | 6/1981 | Meyer et al. . | |
| 4,284,885 | 8/1981 | Swensen . | |
| 4,463,339 | 7/1984 | Frick et al. | 340/906 |
| 4,481,515 | 11/1984 | Benson et al. | 340/916 |
| 4,715,051 | 12/1987 | Giardina . | |
| 4,796,000 | 1/1989 | Mondl . | |

*Primary Examiner*—Donnie L. Crosland

*Attorney, Agent, or Firm*—D. Peter Hochberg; Mark Kusner

[57] ABSTRACT

A traffic controller system to be utilized as a primary or a back-up unit capable of operating both with an A.C. or a D.C. power supply. The apparatus utilizes a single timing capacitor and an array of timing resistors to generate all timing information for the operation of a traffic light.

10 Claims, 15 Drawing Sheets

TRAFFIC LIGHT AND BACK-UP TRAFFIC CONTROLLER

BACKGROUND OF THE INVENTION

The present invention relates to a traffic control system, and in particular relates to an on site pre-timed unit which can be utilized as a back-up unit to centrally controlled traffic control systems or as an inexpensive stand alone unit in areas which cannot easily be controlled by a central system.

Originally traffic control systems were of an electromechanical nature. A motor would rotate a number of cams connected to its shaft. The cams activated contact switches which in turn controlled the traffic lights. These systems suffered from limited reliability, were relatively expensive to manufacture and to maintain, and the timing could only be changed by exchanging the cam set.

Present day stand alone units are mostly digital in nature, and are often programmable through the use of dedicated software. These units are rather expensive to manufacture, are complex and thus prone to failure and require highly skilled maintenance. Moreover, in case of a power failure, they become non-operational.

More sophisticated systems rely on a central master controller which is programmed to control a number of slave units located at the various intersections. These systems are capable of varying the operational timing at the controlled intersections in response to changes in traffic conditions, traffic patterns during the day, weather conditions and other relevant factors. Although highly sophisticated, they become non-operational in the case of power failure or a failure of the master or slave units.

The present invention is designed to be utilized as a back-up unit to either stand alone systems or to master-slave installations and be made operational either in case of failure of the main unit or of the power source.

The traffic controller in the present invention reduces complexity and cost by relying, for the generation of the timing sequence for the operation of the lights, on a novel resistance/capacitor timing circuitry which can generate stable and required long time pulses of varying duration to control the traffic lights.

Although portable back-up units are known (Foreman, U.S. Pat. No. 4,008,404, Feb. 15, 1977), these units rely on digital timing circuitry for the generation of the required time intervals. Such circuitry results in relatively complex and costly equipment.

The present unit is also capable of operating with a DC power supply in case of an AC power failure. Although the operation of electronic equipment with alternate power source is well known and is also utilized in traffic controllers (Studer, U.S. Pat. No. 3,629,000, Dec. 21, 1971), the present unit does not utilize the traditional method of converting the DC power into AC through the use of an inverter but includes independent dual driving circuitry for the AC and DC operation of the traffic lights. This results in better energy utilization and longer battery life in the DC operating mode.

SUMMARY OF THE INVENTION

A primary object of the present invention is to provide a traffic controller which generates stable timing intervals for the control of a traffic light utilizing a relatively inexpensive and reliable RC circuit to generate the appropriate timing sequence and avoid the utilization of digital clocks or electromechanical systems which are more complex, costly and prone to failure.

Another object of the present invention is to provide a digital/analog traffic controller which can automatically change from an alternating current (AC) supply to a continuous current (DC) supply in case of power failure. The present invention does not utilize, in its DC operation, a traditional inverter circuit transforming the DC power supply to an AC voltage but relies on separate driving circuitry and lamp filaments which operate directly off the DC power supply. This implementation results in substantially lower power consumption and longer battery life.

A further object of the present invention is to provide a portable traffic controller which can be utilized as a back-up unit to existing primary units, such as electromechanical controllers, pre-timed digital units, programmable computer driven installations and master-slave systems. If the primary unit operating the traffic light fails, the present unit can be activated to operate the traffic light with a preset timing sequence.

Another object of the invention is to provide a simple and reliable unit which can be utilized as a permanent replacement for obsolete electromechanical units or as a primary unit in areas of relatively constant traffic.

The present invention is aimed at fulfilling the need for a simple and inexpensive design which can be implemented in a portable unit capable of a broad range of application. The controller in the present invention alleviates the problems of cost and reliability encountered in electromechanical traffic controllers and of complexity and cost present in digital timing units.

The timing of the traffic light sequence, which in older units was established by an electromechanical device which included timing cams and in recent controllers by digital clocks and related control circuitry, in the present invention is accomplished by the output pulse of a simple astable multivibrator. The multivibrator sequential timing is determined by a single capacitor discharging sequentially into an array of high value resistors. The connection between the timing capacitor and each of the resistors is accomplished by an array of opto-couplers which are sequentially driven by a shift-register activated by the multivibrator circuitry.

DESCRIPTION OF THE DRAWINGS

The following description of a preferred embodiment of the invention is made with reference to the drawings which form a part of this specification, for all subject matter discussed therein and in which.

DESCRIPTION OF PREFERRED EMBODIMENT

Figure 1:
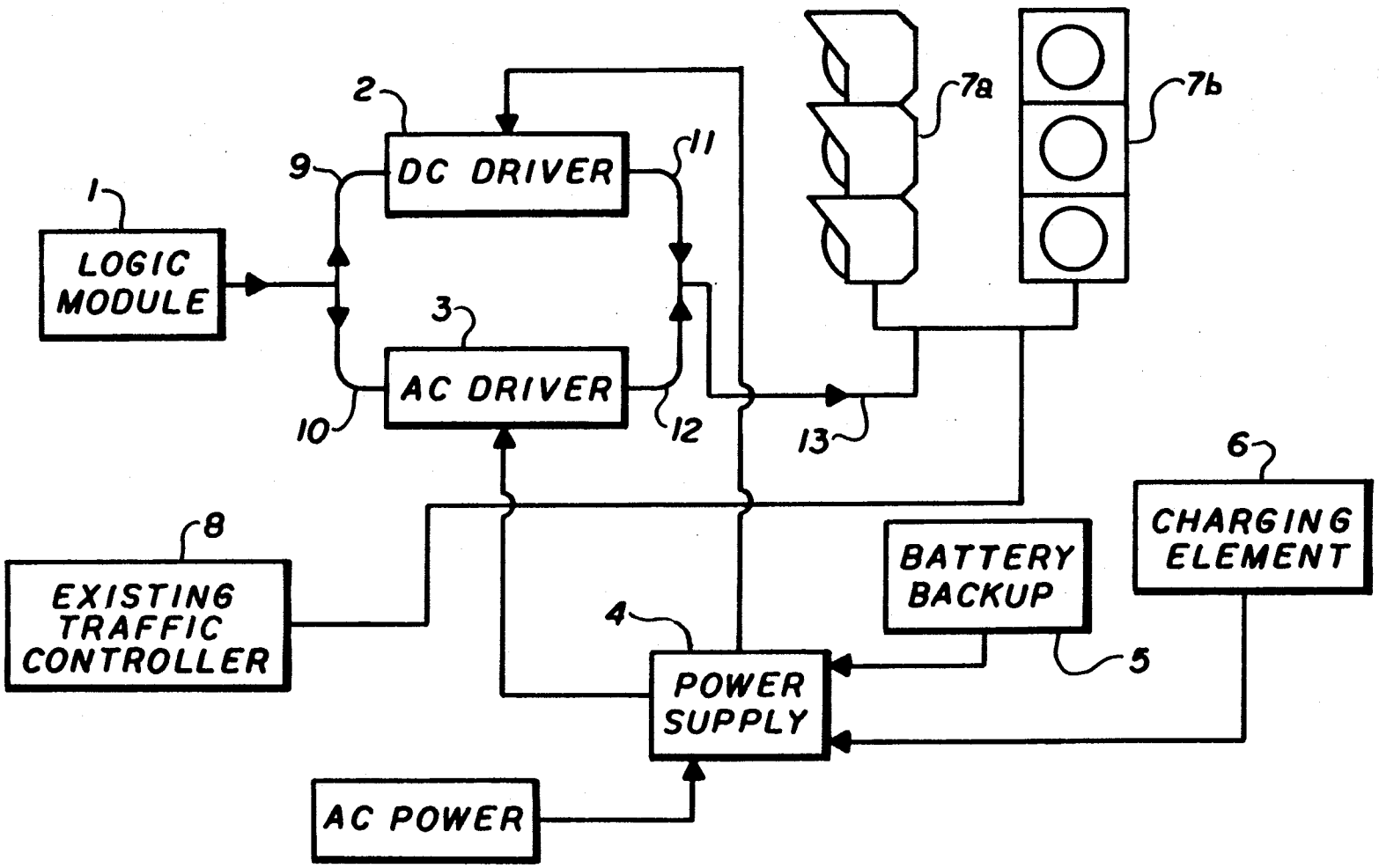
FIG. 1 is a simplified functional block diagram of a preferred embodiment of the present invention.

FIG. 1 is a simplified and block diagram representing a typical installation of the present invention. Logic module 1 contains the control and timing logic of the apparatus. If the apparatus is operating in an AC mode, the time intervals and the timing sequence generated by the logic module 1 are fed, via functional connection 10 to the AC driver circuitry 3. The AC driver, in addition to receiving the timing information from the logic module, also receives power from power supply module 4. The AC power is thus directed to the various lights in traffic lights 7*a* and 7*b* according to the appropriate sequence. If the apparatus has switched to DC operation, the DC driver 2 receives the timing information from the logic module via functional connection 9. The power supply 4 supplies DC power to the DC driver and to traffic lights 7*a* and 7*b*.

The power supply 4 is supplemented by a battery back-up 5 for DC operation and the system may be connected to a charging element 6, such as a solar panel, for recharging the battery back-up system 5.

The logic module, when the traffic controller is utilized as a back-up unit must be paralleled to the existing traffic controller. If a failure of the existing traffic controller occurs, software or hardware, the traffic controller in the present invention can be activated by applying power to it and it will commence operation with a preset timing sequence.

Figure 2:
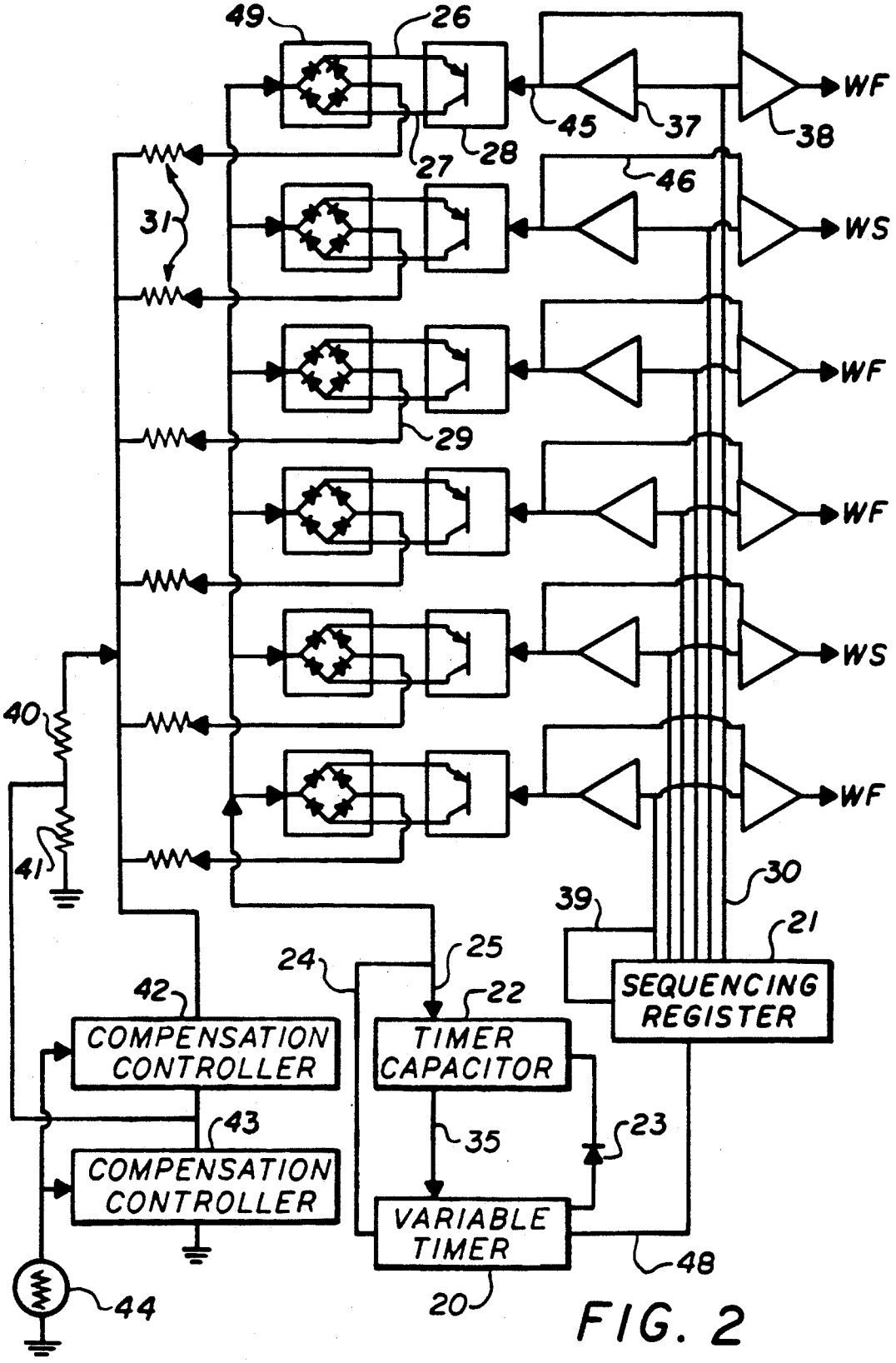
FIG. 2 is a block diagram of the logic module which generates the timing sequence for the operation of the traffic controller in the present invention.

FIG. 2 is a detailed functional diagram of the logic module 1 of FIG. 1. The generation of the time intervals and timing sequence utilizes a variable timer 20 which consists of an astable oscillator or flip-flop. The duration of each pulse of the variable timer is determined by the discharge rate of timer capacitor 22. Once the timer capacitor has discharged to a certain threshold, in the present implementation approximately one-third of full charge, the variable timer is reset through reset line 24, which is connected at the RC junction of capacitor 22, and the variable timer generates the next timing pulse. The traffic controller requires at least 6 distinct time intervals for the operation of a traffic light. The first time interval of relatively long duration controls the north-south red signal and also the east-west green signal. The second long time interval controls the north-south green signal and the east-west red signal. These two time intervals need to be relatively long, in the order of one minute. Two relatively short time intervals of approximately 5 seconds are necessary for the control of the north-south yellow signal and the east-west yellow signal.

Two additional short time intervals of approximately 5 seconds are utilized to maintain the red signals on for an additional period during the transition from red to green in each direction. This is to ensure that all red signals are on at the transition time to allow for additional safety and the clearing of the intersection.

The six time intervals are obtained by changing the RC constant of the discharge path of timer capacitor 22. This is accomplished by sequentially connecting different resistors to timer capacitor 22. The timer resistor array 31, which contains one resistor for each independent time interval required, is connected in series through connections 29 to an array of rectifier bridges 49. The resistors are connected to one of the A.C. terminals of the rectifier bridges. The other A.C. terminals of the rectifier bridges in array 49 are connected to timer capacitor 22. The D.C. terminals of the rectifier bridges are connected to the photo electrically activated devices in photo coupler array 28 through connections 26 and 27. The devices in the photo coupler array 28 are normally open; thus the timer capacitor 22 cannot normally discharge through the timer resistor array 31. The terminals of the resistors in timer resistor array 31 not connected to the rectifier bridge array 49 are connected to a single node which is connected to ground via temperature compensation resistors 40 and 41. Each time the variable timer 20 is reset and generates a pulse it advances the count in sequencing register 21 which in turn sequentially activates one of the amplifiers in the sequencing amplifier array 37. The active amplifier in the array energizes the light emitting diode side of the corresponding photo coupler. The activation of the light emitting diode allows current to flow through the activated photo coupler device and the timer capacitor is thus connected to the corresponding resistor in the timer resistor array. Depending on the R value thus inserted in the discharge path, timer capacitor 22 will discharge more or less rapidly. Once the capacitor has discharged sufficiently, the variable timer is reset through reset line 24. The next pulse is generated, the sequencing register advances and activates the next sequencing amplifier and thus the next photo coupler. The timer capacitor discharge path is changed to the next timer resistor and another time interval is obtained. The sequence is repeated cyclically until all array devices have been activated. At the end of the cycle the sequencing register is reset to zero and the cycle repeats itself. The connection of the resistors in the timer resistor array 31 to the rectifier bridges allows the timer capacitor 22 to be alternatively charged in opposite directions while still allowing the gating of the various resistors through the unidirectional device in the photo coupler array. The utilization of opposite polarities on timer capacitor 22 by charging it through diode 23 and charging and discharging through the rectifier bridge array improves its accuracy and charging speed.

The closed loop timing characteristics of the present invention result in the variable timer pulse duration and the time interval during which the active sequencing amplifier is on to be the same. Both time periods are controlled by the timer capacitor discharge.

In the present embodiment. the capacitance value of timer capacitor 22 was kept relatively low (less than 22 $\mu$F) and to obtain long time interval, high resistor values (approximately 2M ohms) were used in the timer resistor array. This configuration presents the clear advantage of allowing the capacitor to be charged with relative ease, but the discharge currents are very low—of the order of less than 10 micro amperes. Such low currents can result in minute temperature drifts and small timing inaccuracy. Existing traffic controllers are subject to timing drifts of several seconds per cycle. To eliminate timing variations caused by temperature fluctuations, the present invention incorporates a temperature compensation circuit capable of practically eliminating timing drift as the ambient temperature increases. Temperature compensation resistors 40 and 41 are connected in series with the resistors in the timer resistor array. At normal temperature, compensation controllers 42 and 43 present a very low impedance (normally on) and R40 and R41 are shorted. As temperature increases, the value of thermistor 44 varies, first opening temperature compensation controller 42, thus inserting R40 in series with the timer resistor array. At even higher temperature thermistor 44 opens temperature compensation controller 43, thus inserting R41 in series with the resistor array. This compensation results in high timing accuracy at all temperatures.

The output of the sequencing amplifier array 37 is connected to an output buffer array 38. Given the closed loop nature of the system, the amplifiers in the output buffer array are sequentially activated with the same timing of the sequencing amplifiers to generate the necessary timing sequence. The buffer devices are connected both to the AC driver logic to operate the traffic light with AC power and to the DC driver logic to operate the traffic light under DC power.

AC Driver

Figure 3A:
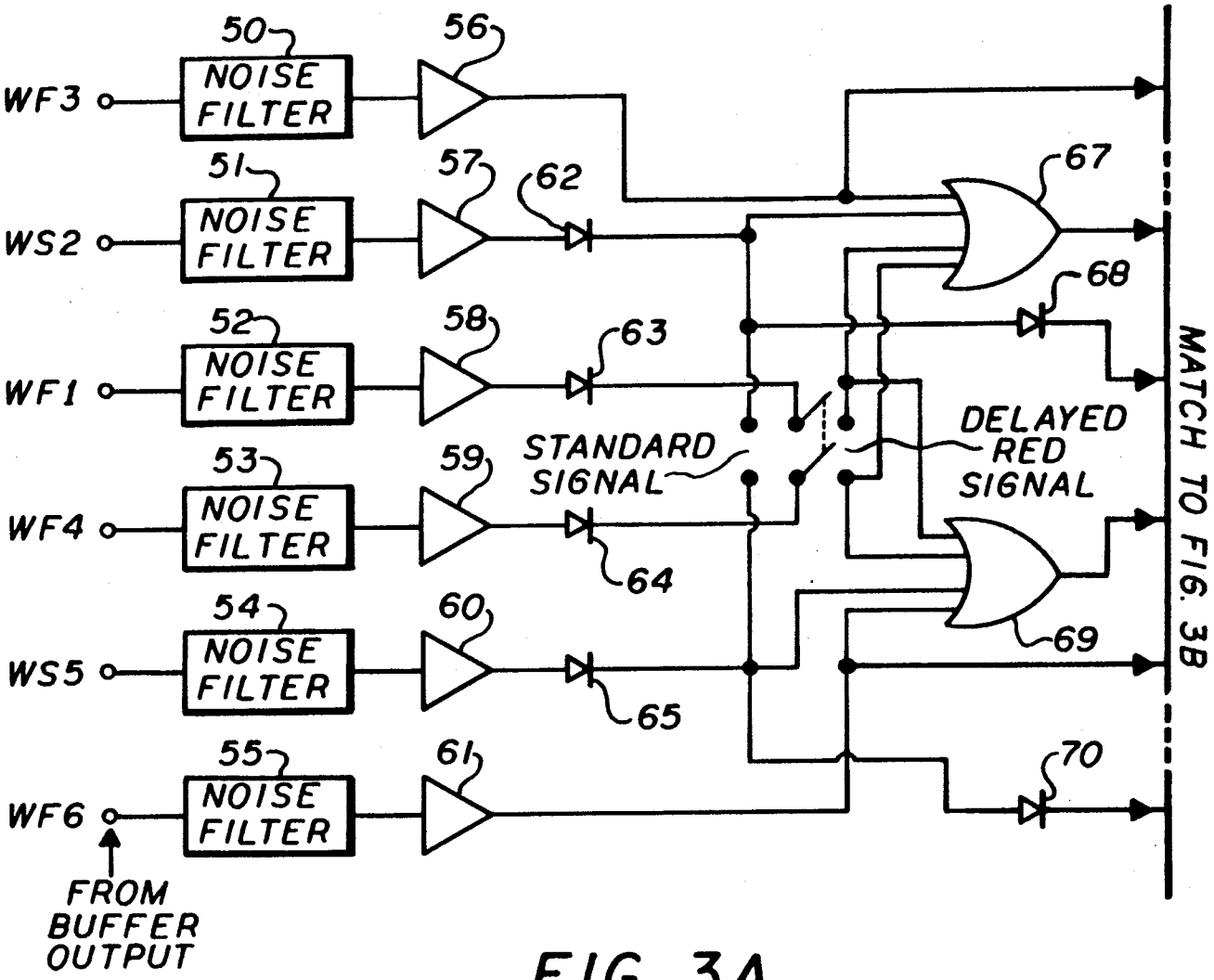
FIGS. 3A and 3B are logic diagrams for the AC driver which drives the traffic lights during AC operation.
Figure 3:
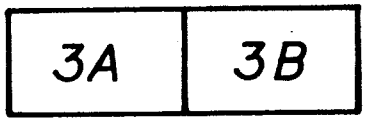
FIG. 3 is a composite view of FIGS. 3A and 3B.
Figure 3B:
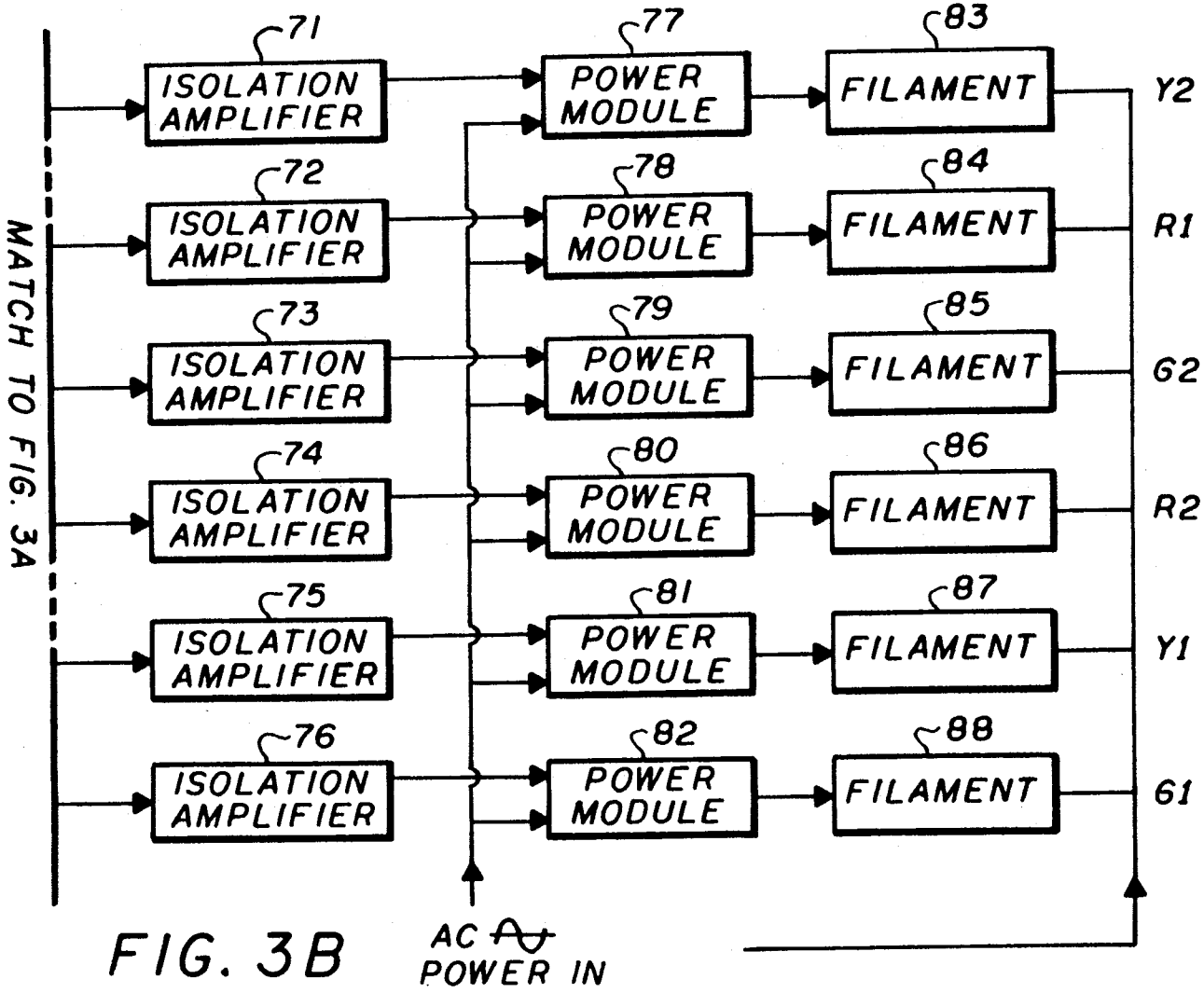

FIG. 3 shows a functional block diagram of the AC driver logic. The function of the AC driver is to process the timing information generated at the output of the buffer array and obtain the proper timing for the north-south red light (R1), the north-south green light (G1), the north-south yellow light (Y1) and the east-west red light (R2), green (G2) and yellow (Y2). In addition, the AC driver connects the AC power supply to the appropriate light filament through the use of a gated semiconductors. In the preferred embodiment the AC power is applied to the light filaments by activating triac devices.

Figure 4:
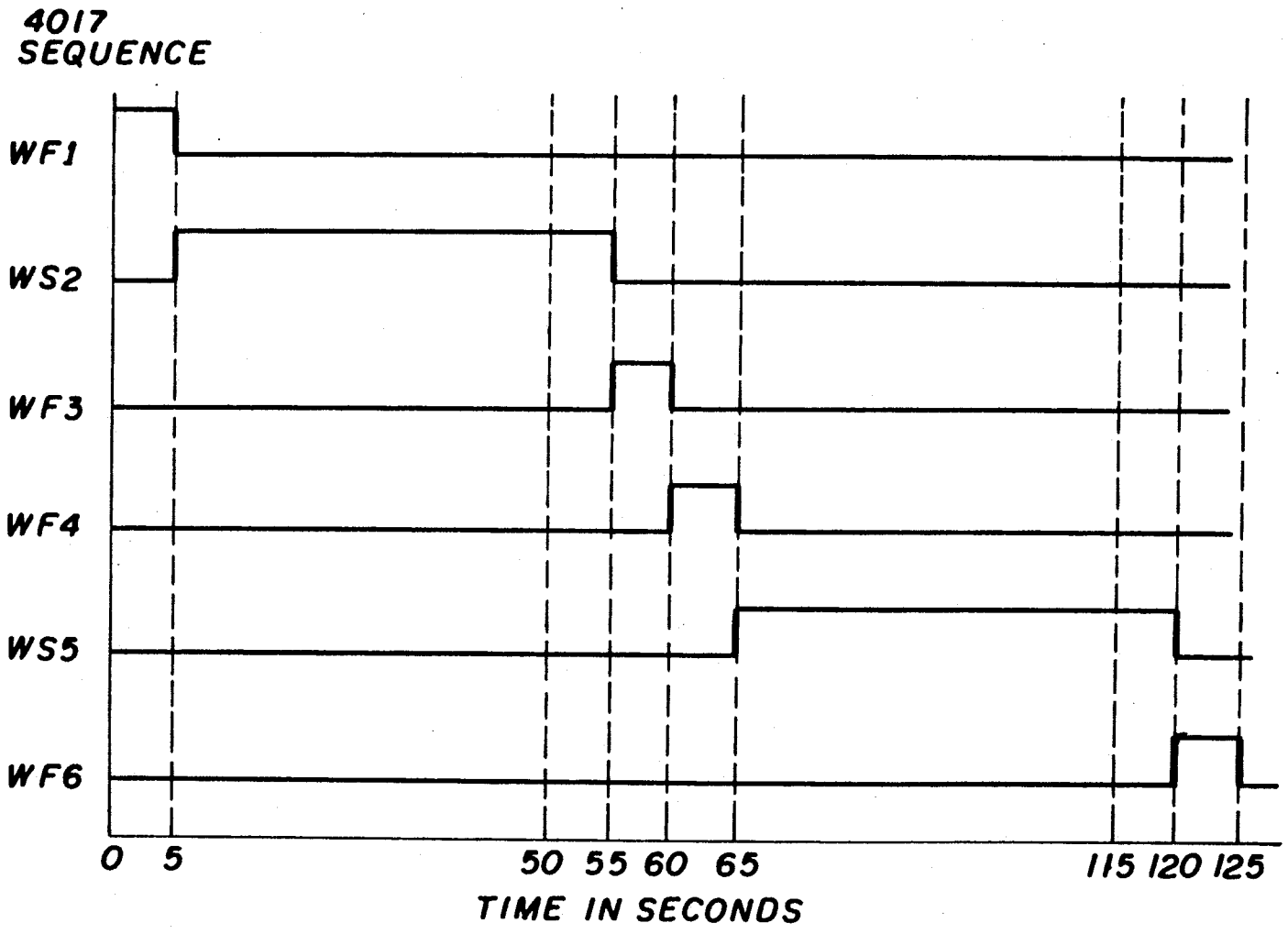
FIG. 4 is a timing diagram of the output of the logic module in FIG. 2.

The AC driver consists of six essentially identical legs interconnected by gates to obtain the desired time outputs. Noise filters 50 through 55 reduce unwanted interference. Amplifiers 56 through 61 condition and increase the power of the time signals. The input signals to the AC driver are shown in FIG. 4. The AC driver contains a switch 66 which can either be connected in a standard signal mode or a delayed red signal mode.

Figure 5:
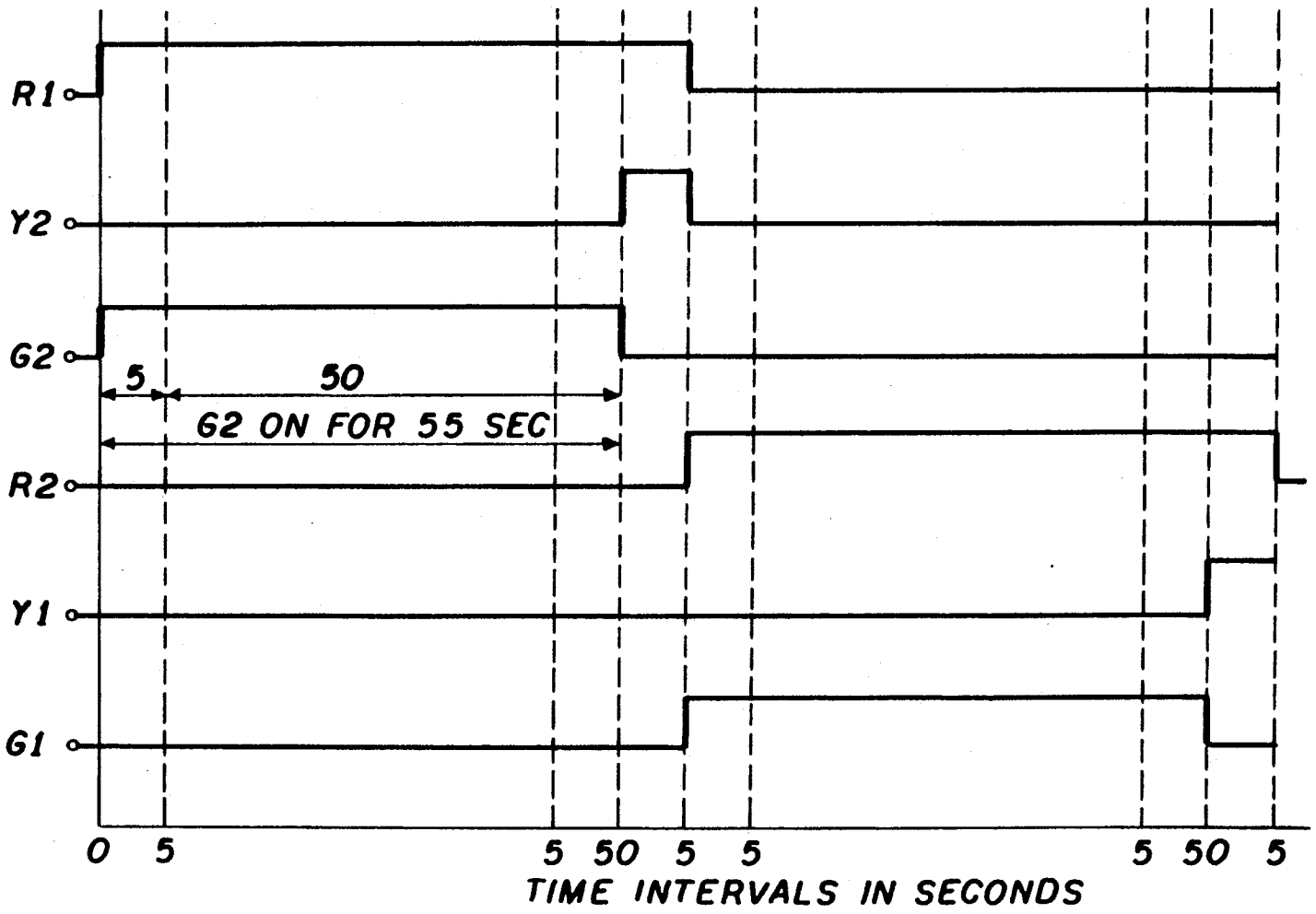
FIG. 5 shows a timing diagram of the lighting sequence of the traffic light under normal operation.

FIG. 5 shows the timing output of the lights when switch 66 is in a standard signal mode. The output of gate 67 is high and R1 is on whenever WF1 or WS2 or WF3 in FIG. 4 are high. As shown in FIG. 5, R1 turns off when the Y2 in the cross direction also turns off. G2 is on and diode 68 is high whenever WF1 or WS2 are high. Gate 69 is high and R2 is on whenever WF4 or WS5 or WF6 are high. The input to isolation amplifier 75 is high and thus Y1 is on whenever WF6 is high. The input to isolation amplifier 76 is high and G1 is on whenever WS5 or WF4 are high.

Figure 6:
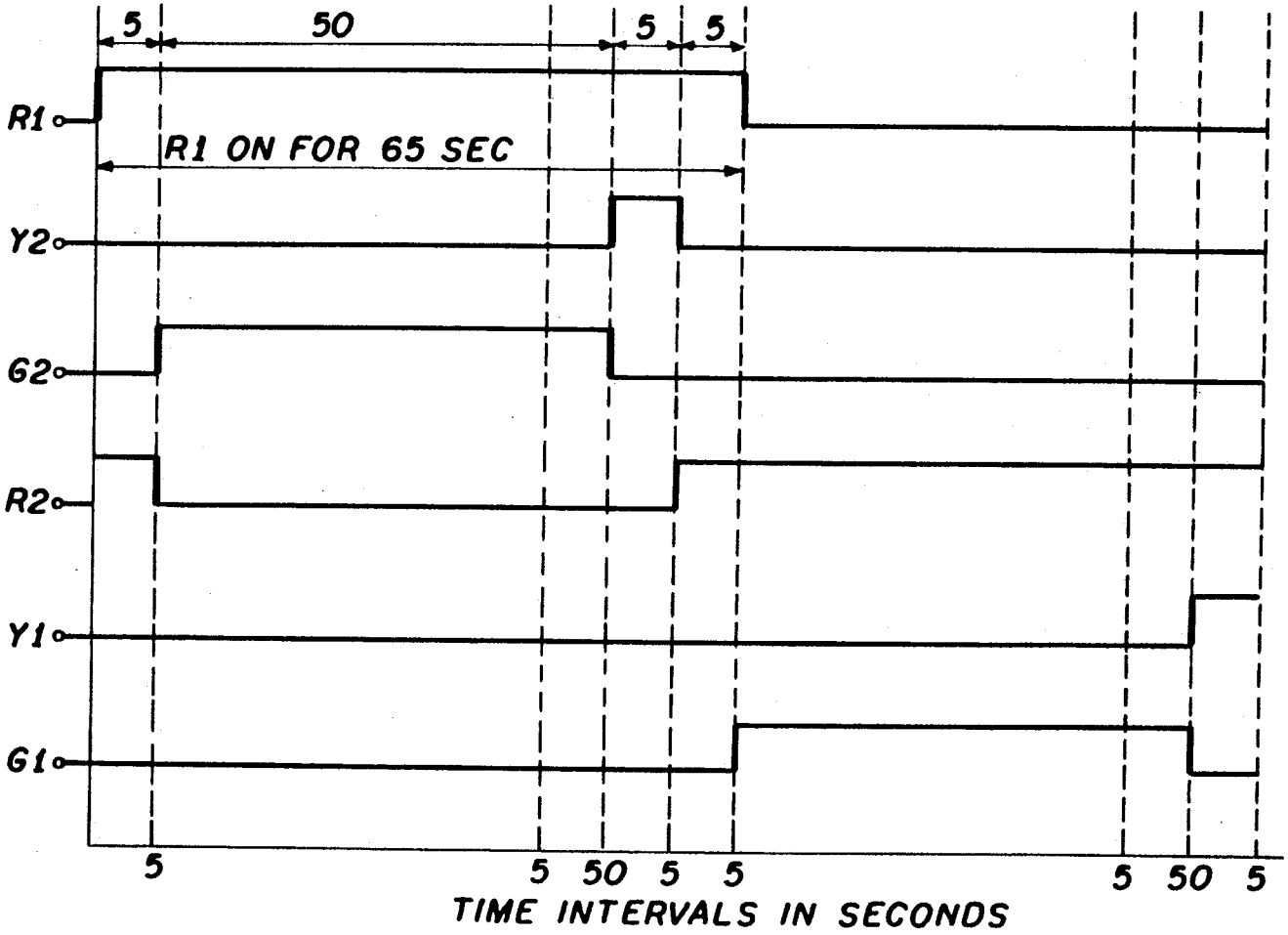
FIG. 6 is a timing diagram of the lighting sequence of the traffic light with a delayed red signal.

With switch 66 in the red delayed mode, the red signals R1 and R2 are extended approximately 5 seconds since R1 is also on whenever WF4 is high and R2 is also on when WF1 is high. The corresponding light timing sequence is shown in FIG. 6.

The timing input to the power output modules 77 through 82 is accomplished by isolation amplifiers 71 through 76. The isolation amplifiers are opto-couplers which isolate the DC logic from the AC current in the power of output modules. The output of each isolation amplifier triggers the corresponding power module 77 through 82 which connects the AC line to filaments 83 through 88. In the preferred embodiment the power output modules are triacs.

DC Driver Operation

The output of buffer amplifiers 38 of FIG. 2 is also connected to a DC driver which is functionally identical to the AC driver described above. The DC driver differs from the AC driver in that it is connected to the DC power source and the power output modules are F.E.T. devices connecting a 24 v DC power source to the DC filaments in the light bulbs.

Power Supply

Figure 7:
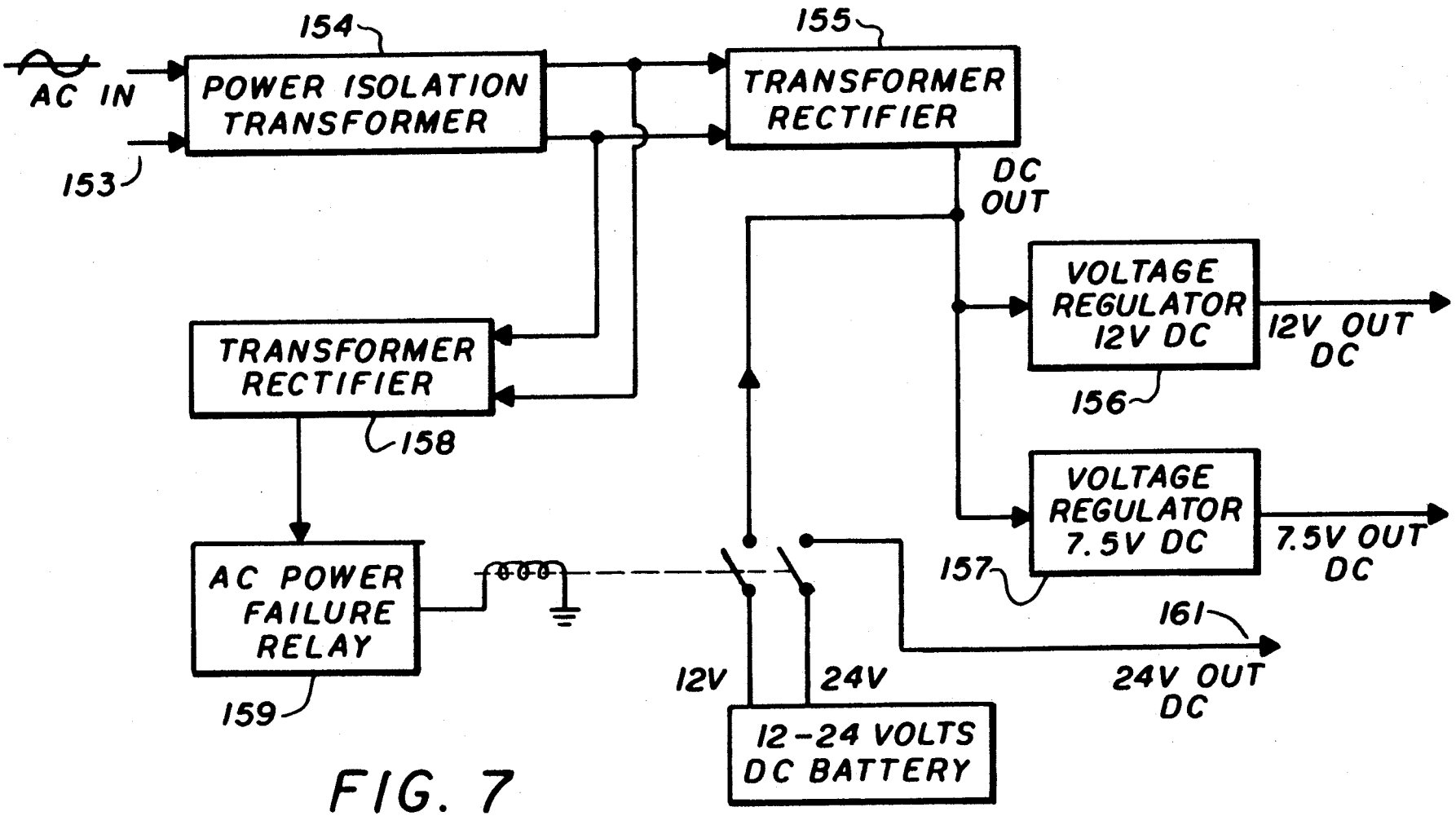
FIG. 7 is a block diagram of the AC-DC power supply in the preferred embodiment.
Figures 8, 8A:
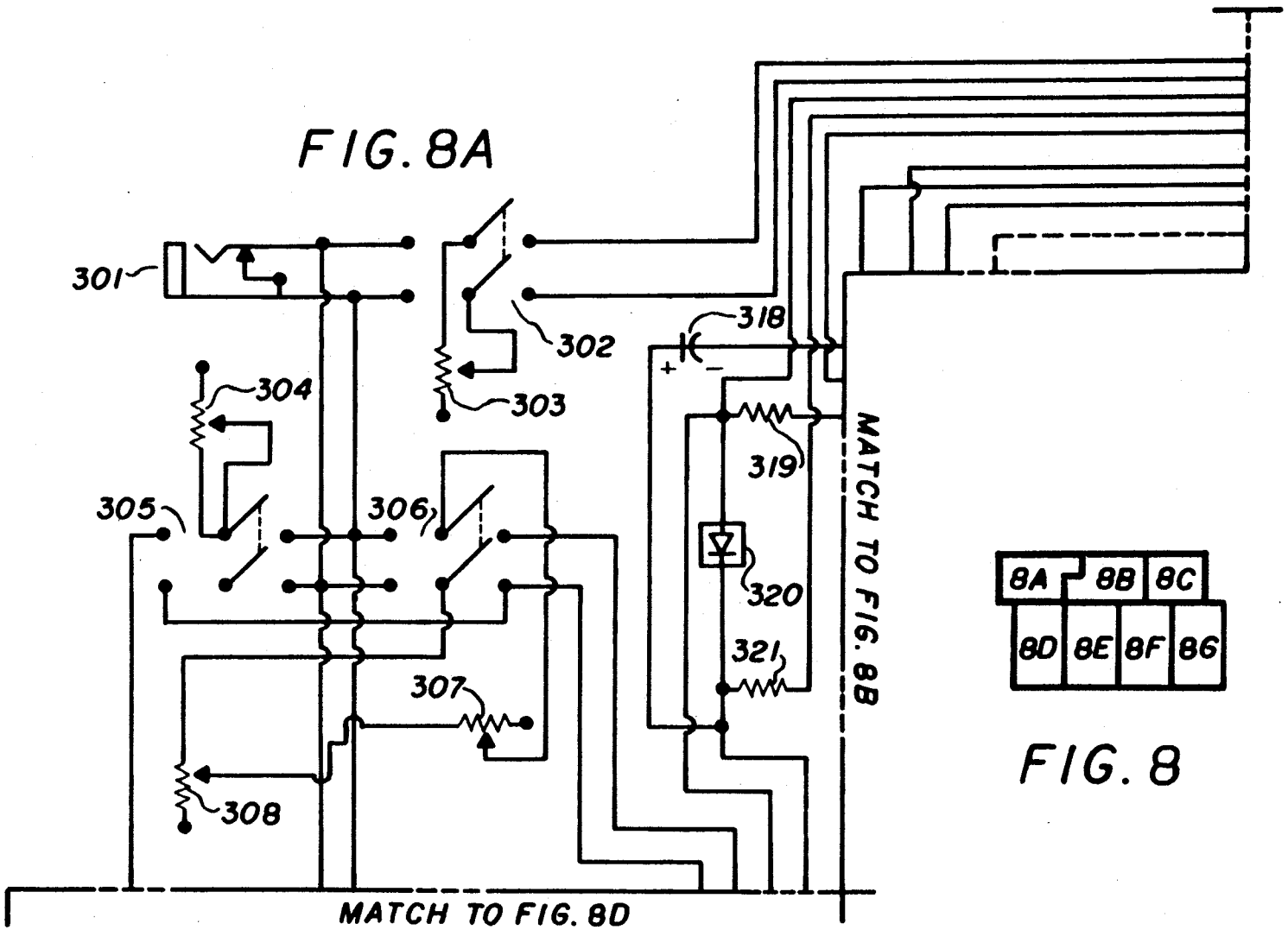
FIG. 8 is a diagram showing interrelationship of the segments of a detailed schematic drawing of the logic module illustrated in FIG. 2.
FIGS. 8A through 8G illustrate segments of a detailed schematic drawing of a logic module shown in FIG. 2.
Figure 8B:
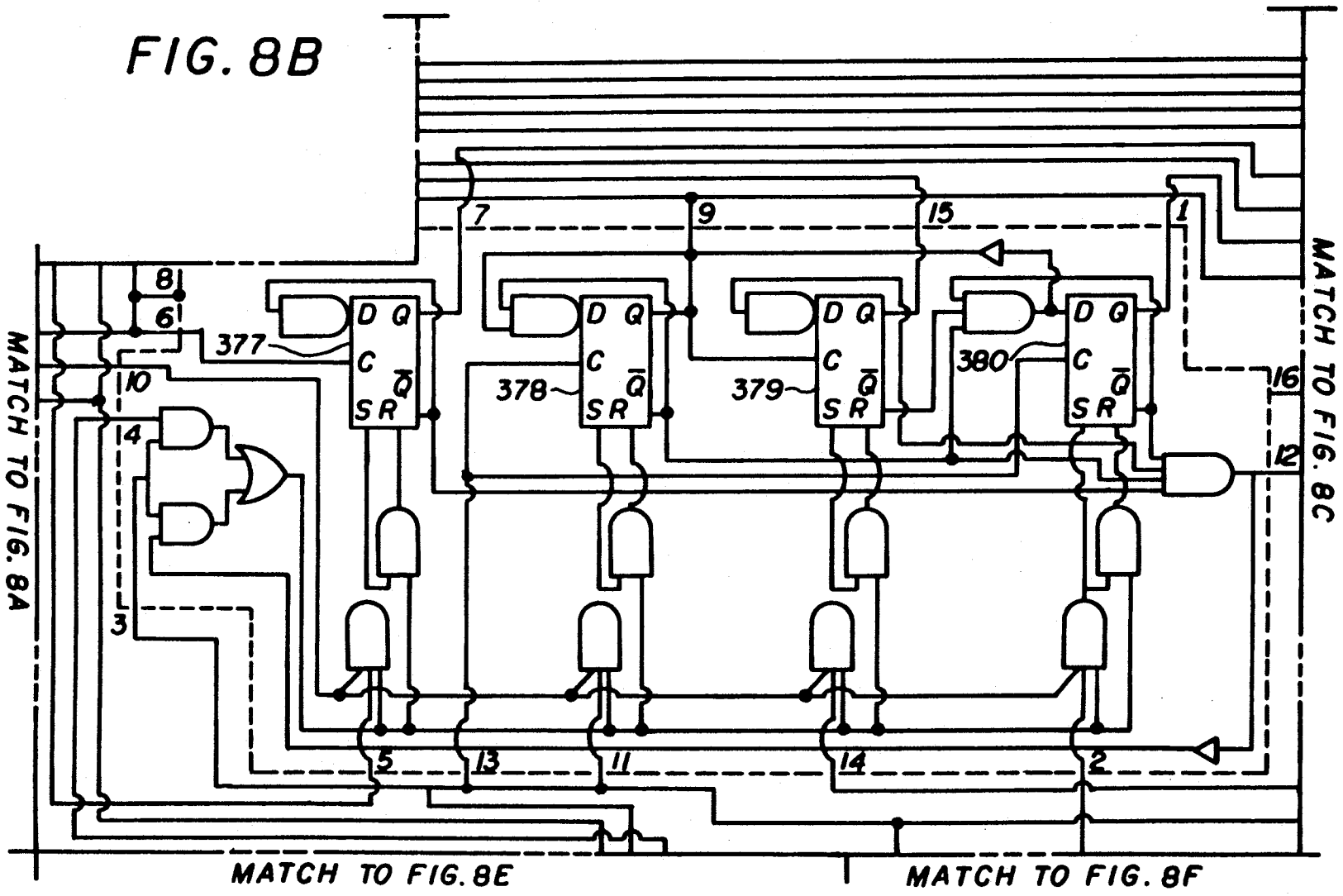
Figure 8C:
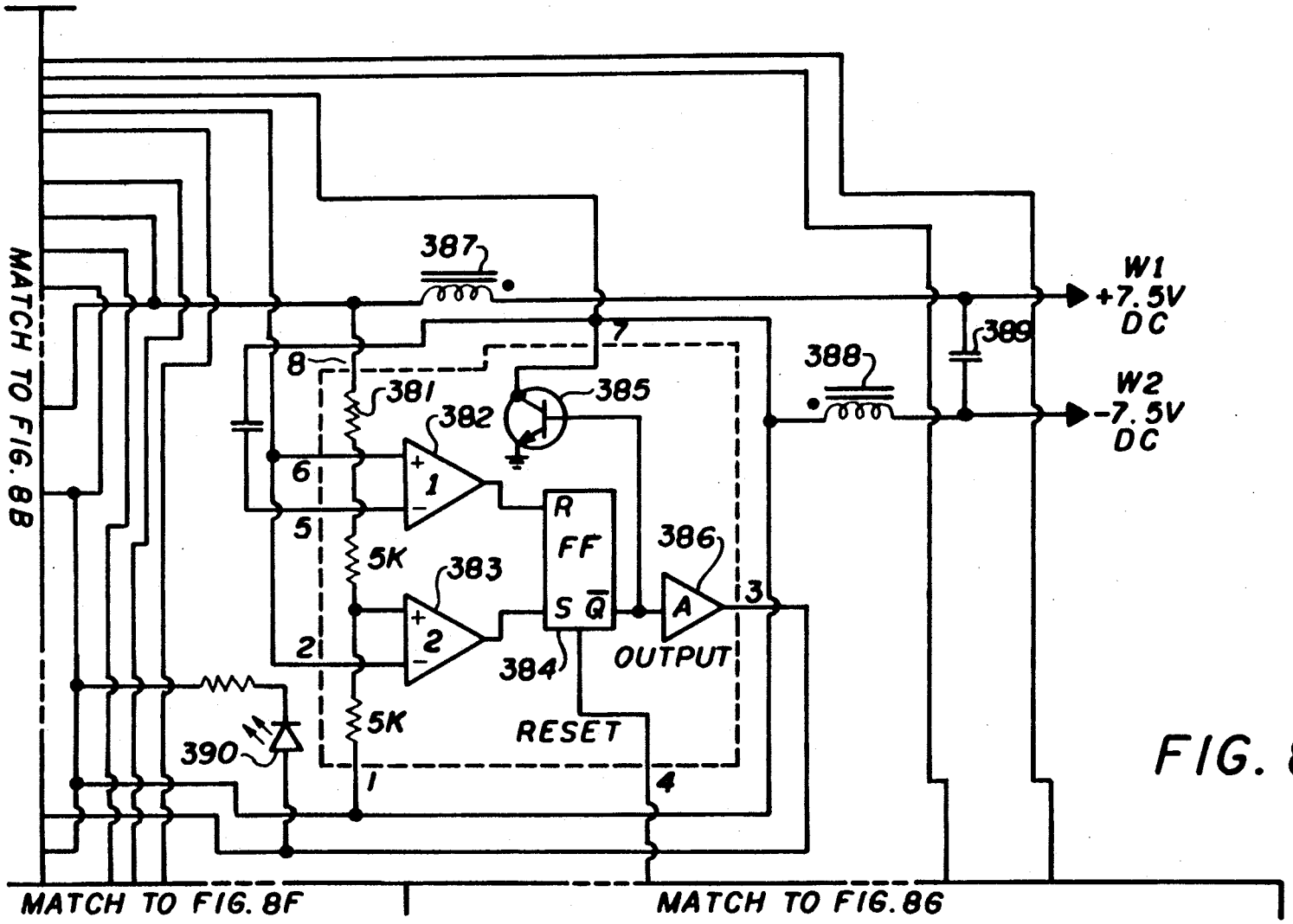
Figure 8D:
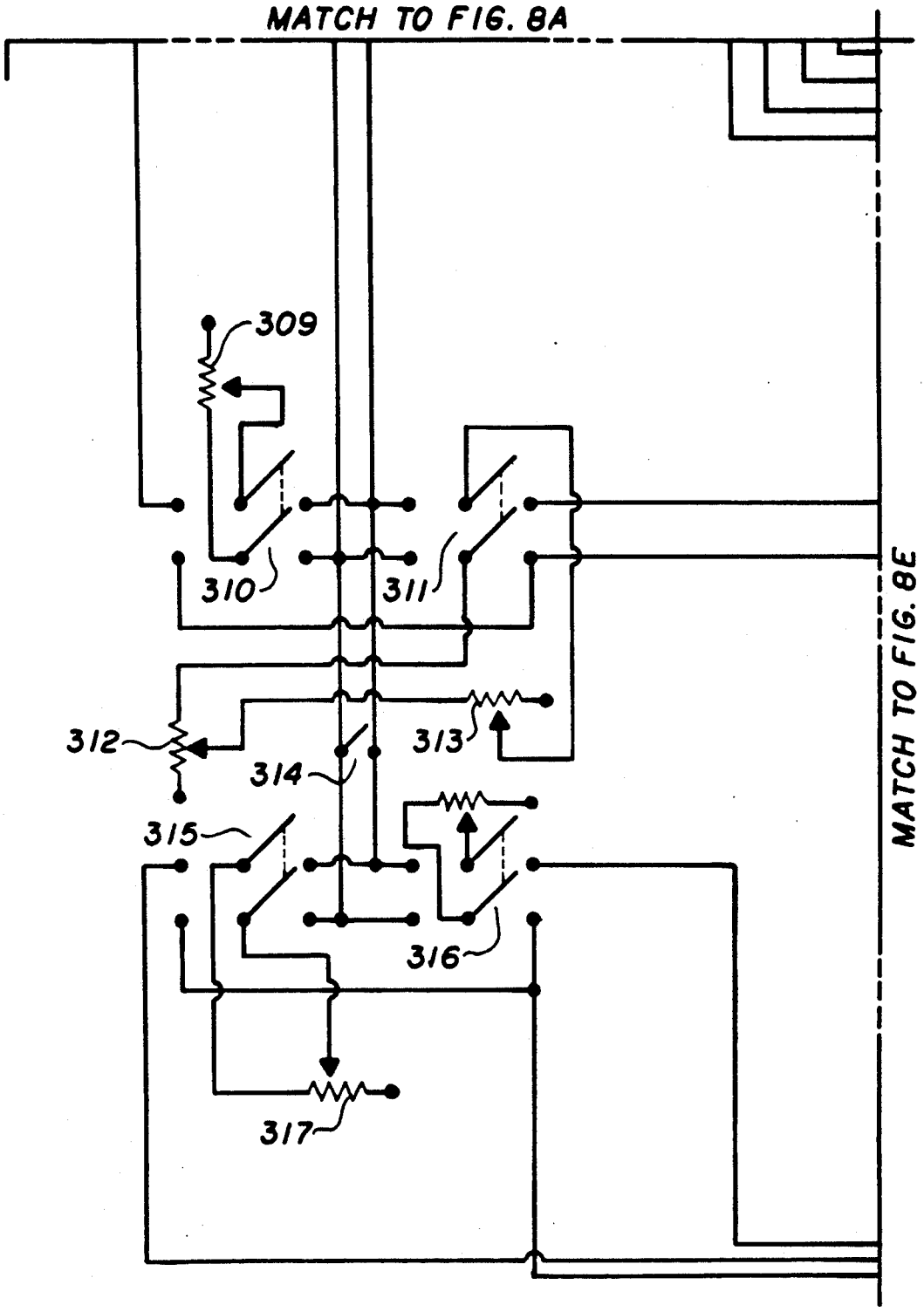
Figure 8E:
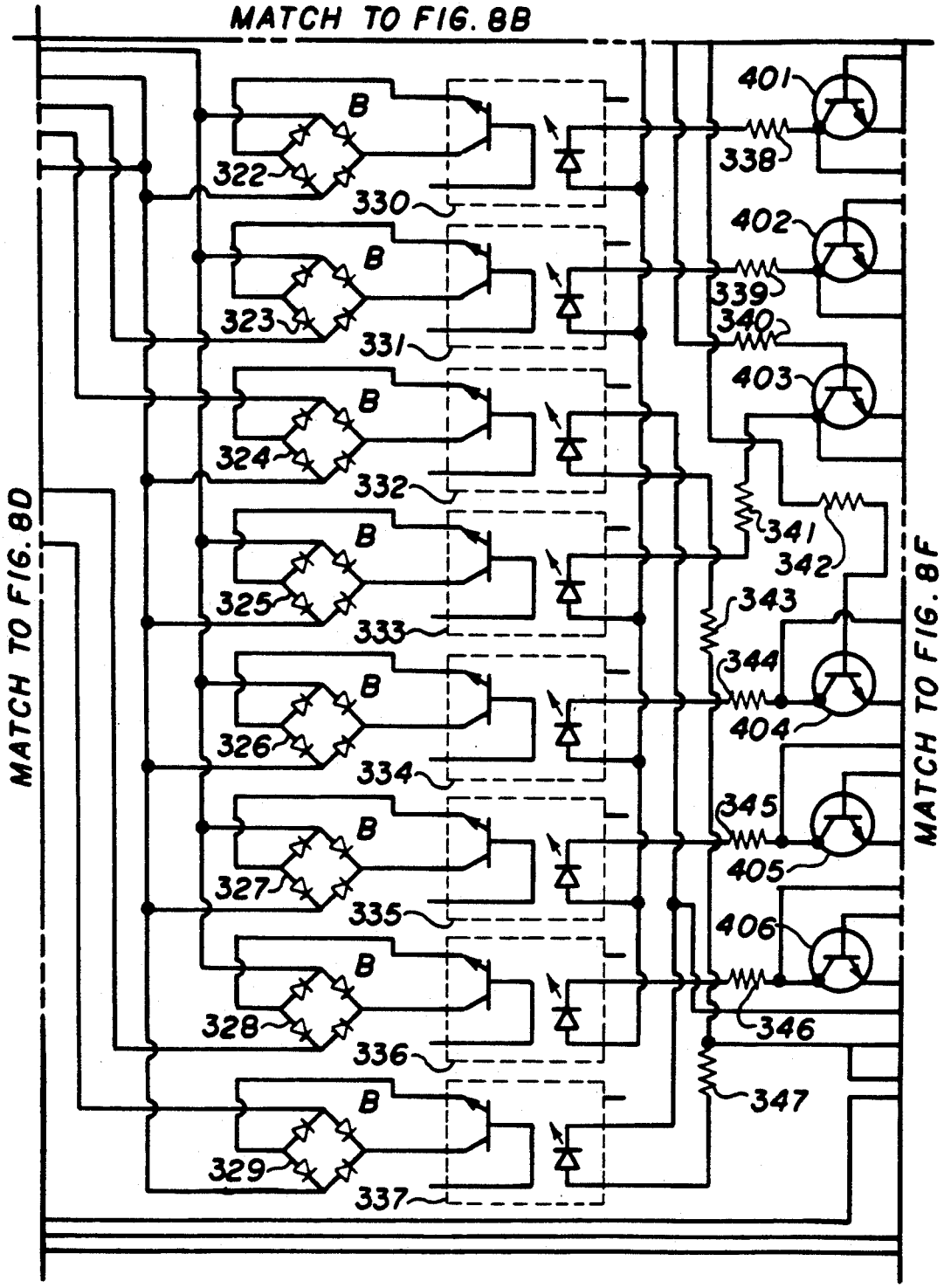
Figure 8F:
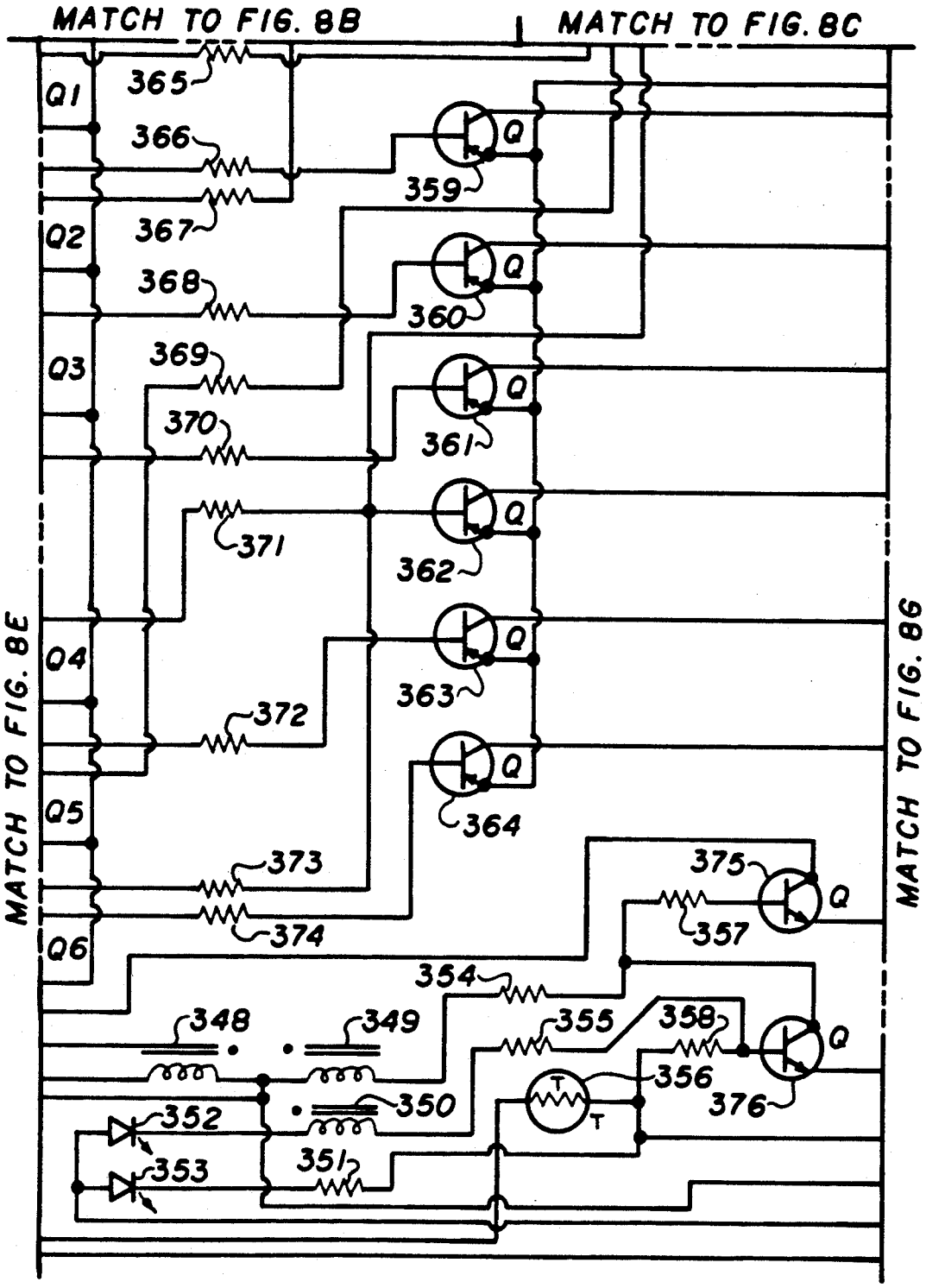
Figure 8G:
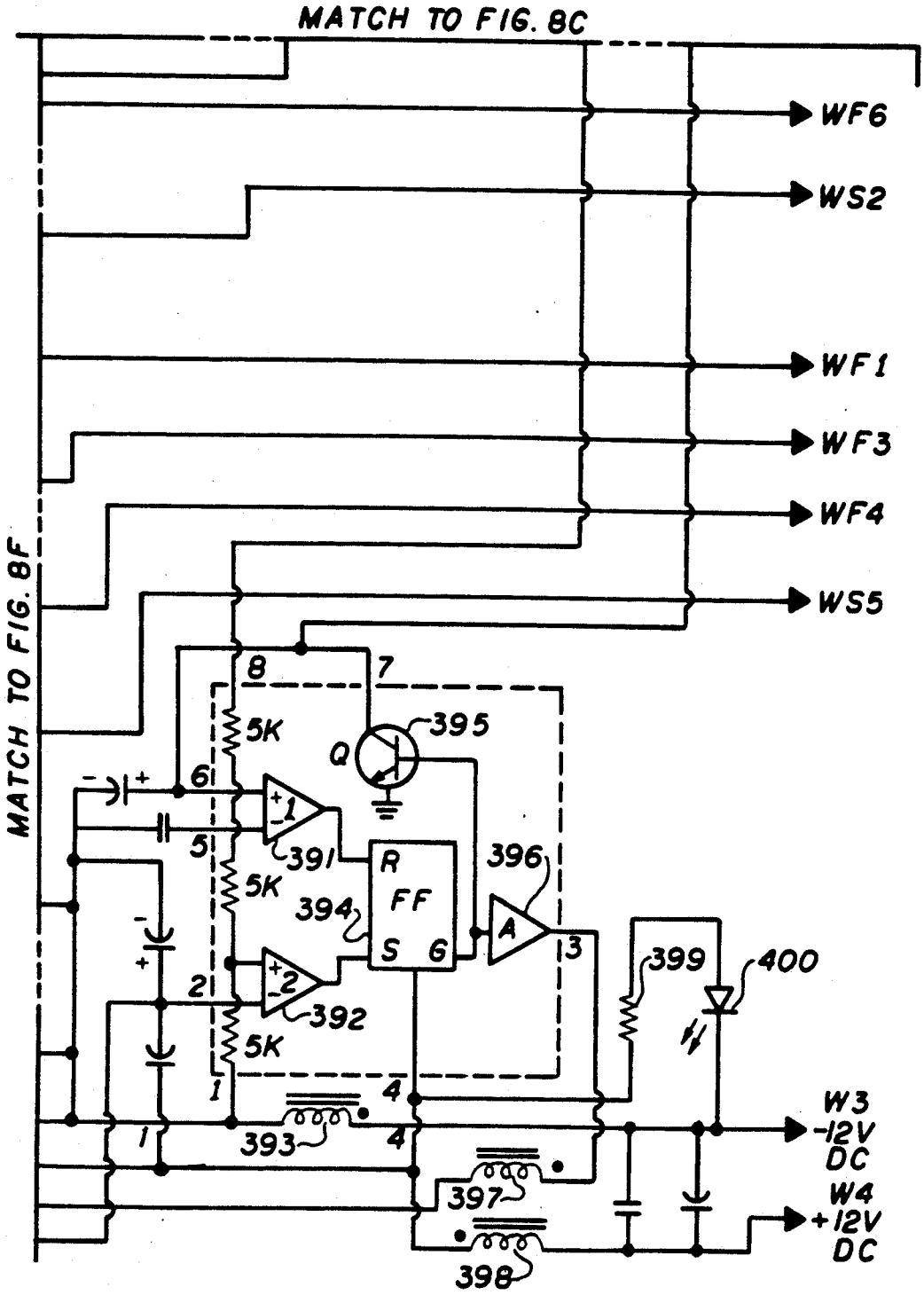

The traffic controller in the present invention contains a power supply of relatively conventional design to supply voltages to the various circuits in the unit. FIG. 7 is a block diagram showing the elements of the power supply. The AC line voltage 153 is fed to a 1 to 1 power isolation transformer 154.

The output of the power isolation transformer is fed to a step down transformer and rectifier circuit 155. Voltage regulator circuits 156 and 157 stabilize and adjust the voltages to 12 v DC and 7.5 v DC respectively. The power isolation transformers supplies an additional 120 v line voltage transformer and rectifier 158 which energizes an AC power failure relay 159. If AC power is present, the AC power failure relay 159 is energized and contacts 161 are normally open. If the AC power supply fails, the AC power failure relay 159 is deenergized and contacts 161 close, connecting the 12 v output of the 12–24 v DC battery to voltage regulators 156 and 157 thus continuing to provide power to the traffic controller circuitry. In addition, contacts 161 also close to provide 24 v DC to the output stages of the DC driver and the DC filaments contained in the light sources of the traffic light. An AC power failure thus automatically switches the traffic controller from AC power operation to auxiliary DC power operation.

FIGS. 8A through 8G show detailed schematics of the system described in FIG. 2. In this detailed schematic comparators 382 and 383, transistor 385, flip-flop 384 and buffer 386 perform the function of variable timer 20 in FIG. 2. Capacitor 318 is the timer capacitor of the apparatus.

The resistor array for the discharge of capacitor 318 consists of resistors 303, 304, 307, 308, 309, 312, 313, 317 and 401. Rectifier bridges 322 through 329 constitute the rectifier bridge array. Photo couplers 330 through 337 when activated sequentially connect the resistors in the resistor array to timer capacitor 318. Semiconductors 401 through 406 and 359 through 364 are the sequencing amplifier array and the output buffer array respectively.

The combination of registers 377 through 380 implement the sequencing register for selectively activating the photo couplers. Thermistor 356 senses ambient temperature and through transistors 375 and 376 first inserts resistor 304 and then resistor 309 to achieve the desired temperature compensation.

A large family of different apparatus utilizing the sequential RC timing configuration of the present invention will be obvious to those skilled in the art.

The invention has been described in sufficient detail to enable those skilled in the art to practice the invention. Variations and modifications within the spirit and scope of the invention may occur to those skilled in the art from the specification and from the appended claims.

What is claimed is:

1. Apparatus for operating a traffic control having a plurality of lights, said apparatus comprising:

variable timer means for generating time interval signals having a timing sequence for controlling said plurality of lights, and timer capacitor means operatively connected to said variable timer means for holding an electrical charge whose rates of discharge determines the time intervals generated by said variable timer means, and timer resistor array for varying a resistance-capacitance constant of a discharge path of said timer capacitor means, comprising timer resistor means, said timer resistor means being sequentially connected to said timer capacitor means for providing said rates of discharge, and coupling array for sequentially connecting said timer capacitor means with said timer resistor means of said timer resistor means array, and rectifier bridge array for supplying direct current to said coupling array comprising rectifier bridge means, said rectifier bridge means being operatively interposed between said timer capacitor means and said timer resistor array for obtaining a unidirectional current flow in said coupling array, and sequencing register means for sequentially selecting a particular coupling within said coupling array, said sequencing register means being responsive to said variable timer means.

2. Apparatus according to claim 1 wherein said coupling array comprises photo coupler devices containing a semiconductor which is gated by the light output of a photo active device, said semiconductor being conductive when the photoactive device is energized and wherein a collector side of said semiconductor is connected to a cathode direct current junction of the corresponding rectifier bridge array and an emitter side is connected to an anode direct current junction of said rectifier bridge array.

3. Apparatus according to claim 2 and further including:

sequencing amplifier array for conditioning the output of said sequencing register means for driving said coupling array, and output buffer means array operatively connected to said sequencing amplifier array for providing sequential timing information for said plurality of lights.

4. Apparatus according to claim 3 and further including:

first and second impedance means connected in series with said timer resistor array for adjusting an impedance of said resistor array when ambient temperature increases, and temperature sensing means for sensing the ambient temperature in the apparatus, and first temperature controller means connected to said temperature sensing means for enabling said first impedance means when a first preselected temperature t1 is sensed in the apparatus, and second temperature controller means connected to said temperature sensing means for enabling said second impedance means when a second preselected temperature t2 is sensed in the apparatus.

5. Apparatus according to claim 4 and further including an alternating current driver means operatively connected to said output buffer means array for sequentially connecting said plurality of lights to an alternating current power source.

6. Apparatus according to claim 5 and further including:

noise filter array for reducing noise signals in said alternating current driver means, and conditioning amplifier array for increasing a power level and improving signal shape of said time interval signals, and time interval signals combining means for selectively combining said time interval signals to obtain the desired timing sequence to operate said traffic control, and isolation amplifier array for increasing a power level of the output of said interval signals combining means, and power output module array controlled by said isolation amplifier array for applying alternating current power to light filaments of said traffic control.

7. Apparatus according to claim 6 wherein said power output module array consists of an array of triacs.

8. Apparatus according to claim 7 and further including direct current driver means operatively connected to said output buffer means array for sequentially connecting said plurality of lights to a direct current power source.

9. Apparatus according to claim 6 wherein said power output module array consists of an array of field effect semiconductors.

10. Apparatus according to claim 6 and further including:

power isolation means for isolating a power supply and the apparatus from alternating current line voltage, and first transformer and rectifier means connected to said power isolation means for reducing the alternating current line voltage to a desired level and rectifying it to provide a direct current voltage, and first voltage regulator means connected to said first transformer and rectifier means for generating a first lower level direct current voltage, and second voltage regulator means connected to said first transformer and rectifier means for generating a second intermediate level direct current voltage, and second transformer and rectifier means connected to said power isolation means to provide a third higher level direct current voltage, and A.C. power failure detection means for detecting a power failure in the alternating current line supply, and power source selection means, controlled by said A.C. power failure detection means, for connecting an auxiliary direct current power source to said first and second voltage regulator means, and to said third higher level direct current voltage in case of an alternating current power failure.

* * * * *